US009851684B2

(12) United States Patent
Yamasaki

(10) Patent No.: US 9,851,684 B2
(45) Date of Patent: Dec. 26, 2017

(54) ENGAGING MECHANISM FOR MOVABLE PANEL IN IMAGE FORMING APPARATUS

(71) Applicant: FUJI XEROX CO., LTD., Tokyo (JP)

(72) Inventor: Shunsuke Yamasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/227,026

(22) Filed: Aug. 3, 2016

(65) Prior Publication Data

US 2017/0248899 A1 Aug. 31, 2017

(30) Foreign Application Priority Data

Feb. 28, 2016 (JP) ..... 2016-036537

(51) Int. Cl.
*G03G 21/00* (2006.01)
*G03G 21/16* (2006.01)

(52) U.S. Cl.
CPC . *G03G 21/1633* (2013.01); *G03G 2221/1687* (2013.01)

(58) Field of Classification Search
CPC ..... G03G 21/1633; G03G 21/1647; G03G 2221/1654; G03G 2221/1687; G03G 2221/169; Y10T 292/10; Y10T 292/1002; E05C 19/02; E05C 19/063
USPC ..... 399/110; 49/394; 312/215, 222; 292/295, 296, 297, 298
See application file for complete search history.

(56) References Cited

U.S. PATENT DOCUMENTS 4,159,153 A * 6/1979 Yoshikawa ..... G07G 1/0027 292/DIG. 4
5,518,282 A * 5/1996 Sawada ..... E05B 17/2011 292/128
8,737,868 B2 * 5/2014 Tanabe ..... G03G 21/1633 399/107
2009/0169249 A1 * 7/2009 Watanabe ..... E05C 19/02 399/114
2011/0052253 A1 * 3/2011 Nieda ..... E05C 19/02 399/110
2016/0291532 A1 * 10/2016 Abe ..... G03G 21/1633

FOREIGN PATENT DOCUMENTS

JP 2008-254841 A 10/2008
JP 2008310151 A * 12/2008
JP 2011-53335 A 3/2011

* cited by examiner

*Primary Examiner* — Robert Beatty
(74) *Attorney, Agent, or Firm* — Sughrue Mion, PLLC

(57) ABSTRACT

An image forming apparatus includes: an open/close member supported so as to be movable between an open position at which an inside of an apparatus body is exposed and a closed position at which the apparatus body is closed; an engaged portion provided on the apparatus body; an engaging member having an engaging portion that is engageable with the engaged portion and a lever portion that contacts the engaged portion to guide the engaging portion to the engaged portion when the open/close member is moved from the open position to the closed position, the engaging member being provided on the open/close member and being rotatable forward and in reverse; and an urging member that urges the engaging member. The urging direction of the urging member is changeable between fixing and releasing directions in which the engaging member is drawn into and moved away from the engaged portion, respectively.

10 Claims, 9 Drawing Sheets

ENGAGING MECHANISM FOR MOVABLE PANEL IN IMAGE FORMING APPARATUS

CROSS-REFERENCE TO RELATED APPLICATIONS

This application is based on and claims priority under 35 USC 119 from Japanese Patent Application No. 2016-036537 filed Feb. 28, 2016.

BACKGROUND

Technical Field

The present invention relates to an image forming apparatus.

SUMMARY

According to an aspect of the present invention, there is provided an image forming apparatus including: an open/close member supported so as to be movable between an open position at which an inside of an apparatus body is exposed and a closed position at which the inside of the apparatus body is covered; an engaged portion provided on one of the apparatus body and the open/close member; an engaging member having an engaging portion that is engageable with the engaged portion and a lever portion that contacts the engaged portion to guide the engaging portion to the engaged portion when the open/close member is moved from the open position to the closed position, the engaging member being provided on the other of the apparatus body and the open/close member and being rotatable forward and in reverse; and an urging member that urges the engaging member, an urging direction of the urging member being changeable between two urging directions including a fixing direction in which the engaging member is drawn into the engaged portion and a releasing direction in which the engaging member is moved away from the engaged portion.

BRIEF DESCRIPTION OF THE DRAWINGS

An exemplary embodiment of the present invention will be described in detail based on the following figures, wherein.

DETAILED DESCRIPTION

Figure 1:
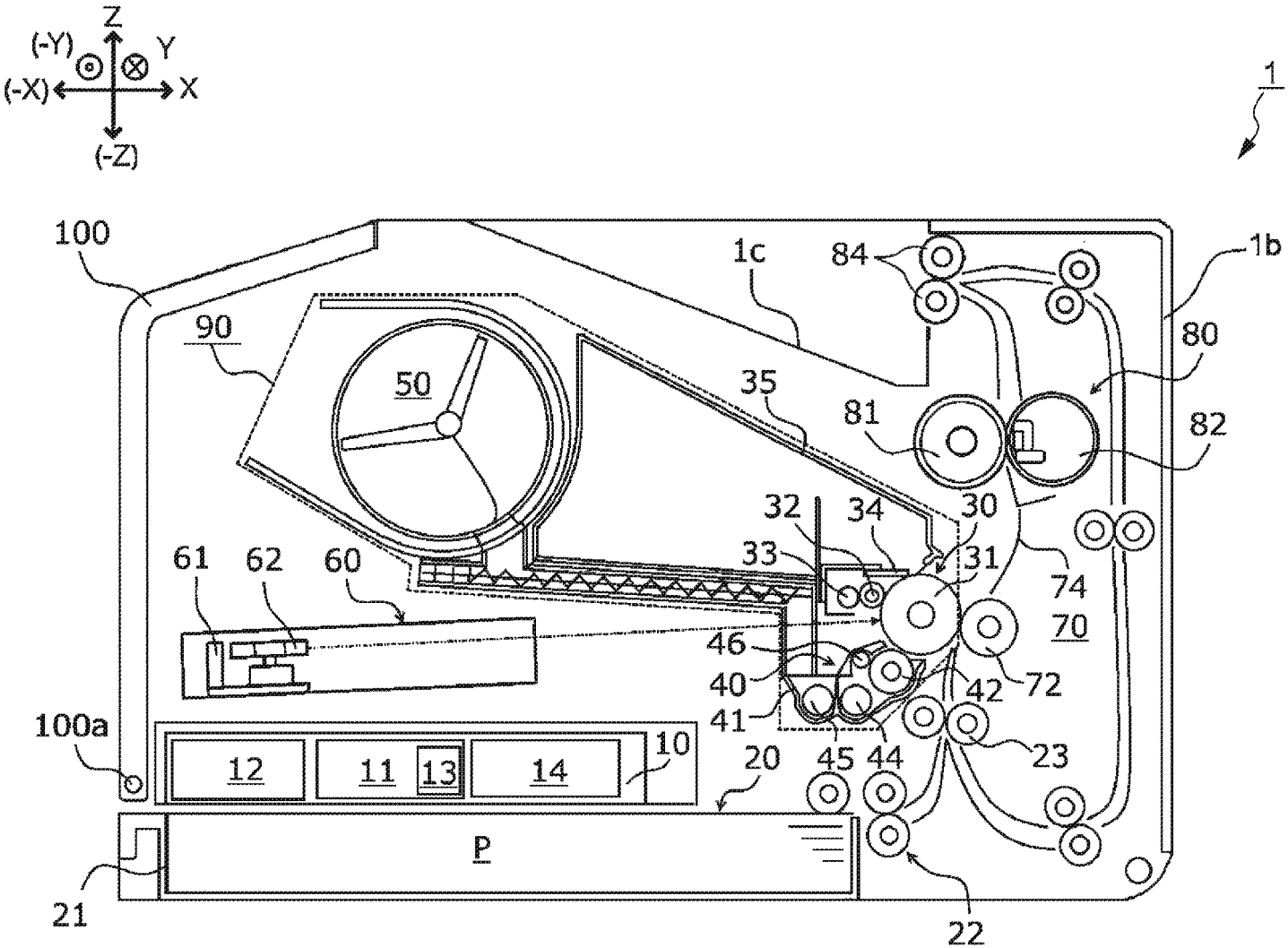
FIG. 1 is a schematic sectional view illustrating the internal configuration of an image forming apparatus 1.

An exemplary embodiment and a specific example of the present invention will be described in detail below with reference to the drawings. The present invention is not limited to the following exemplary embodiment and specific example.

It should be noted that, in the following description of the drawings, the drawings are schematic and the ratio of dimensions etc. may be different from the actual value, and that members other than those required to describe the present invention may not be illustrated as appropriate for ease of understanding.

In the drawings, in order to facilitate understanding of the following description, the front-rear direction is defined as the X-axis direction, the left-right direction is defined as the Y-axis direction, and the up-down direction is defined as the Z-axis direction.

(1) Overall Configuration and Operation of Image Forming Apparatus

FIG. 1 is a schematic vertical sectional view illustrating the internal configuration of an image forming apparatus 1 according to an exemplary embodiment.

The overall configuration and operation of the image forming apparatus 1 will be described below with reference to the drawing.

The image forming apparatus 1 includes a control device 10, a paper transport device 20, a photosensitive unit 30, a developing device 40, a toner cartridge 50, an exposure device 60, a transfer device 70, and a fixing device 80.

An open/close member 100 is rotatably supported on the front surface of the image forming apparatus 1. The open/close member 100 is opened forward (−X direction) to expose the inside of the image forming apparatus 1 for replacement of consumables etc.

A rear cover 1*b* is rotatably supported on the rear surface of the image forming apparatus 1. The rear cover 1*b* is opened to expose the inside of the image forming apparatus 1 for an internal check for a paper jam etc.

An upper cover 1*c*, which also serves as an ejection tray for ejection and storage of paper on which an image has been recorded, is formed on the upper surface (Z direction) of the image forming apparatus 1.

The control device 10 includes an image forming apparatus control section 11, a controller section 12, an exposure control section 13, a power source device 14, and so forth. The image forming apparatus control section 11 controls operation of the image forming apparatus 1. The controller section 12 prepares image data according to a printing process request. The exposure control section 13 controls lighting of a light source of the exposure device 60. The power source device 14 applies a voltage to a charging roller 32, a developing roller 42, a transfer roller 72, and so forth to be discussed later, and supplies power to the exposure device 60.

The controller section 12 converts image data input from an image reading device (not illustrated) and printing information input from an external information transmission device (such as a personal computer, for example) into image information for latent image formation, and outputs a drive signal to the exposure control section 13 at a timing set in advance.

The paper transport device 20 is provided at the bottom portion of the image forming apparatus 1. The paper transport device 20 includes a paper cassette 21. A large number of sheets of paper P, which serve as a recording medium, are loaded on the upper surface of the paper cassette 21. The paper P, the position of which in the width direction is determined by restriction plates (not illustrated), is drawn rearward (X direction) from above, one sheet at a time, by a paper drawing portion 22, and thereafter transported to a contact portion of a registration roller pair 23.

The photosensitive unit 30 is provided above the paper transport device 20, and includes a photosensitive drum 31 provided in a unit housing 35 and rotationally driven. The charging roller 32, the developing device 40, the transfer roller 72, and a cleaning blade 34 are disposed along the rotational direction of the photosensitive drum 31. A cleaning roller 33 is disposed to face and contact the charging roller 32 to clean the surface of the charging roller 32.

The developing device 40 includes a developing housing 41 that stores a developer inside. The developing roller 42 and a pair of augers 44 and 45 are disposed in the developing housing 41. The developing roller 42 is disposed to face the photosensitive drum 31. The augers 44 and 45 are provided obliquely below and on the back side of the developing roller 42 to agitate and transport the developer toward the developing roller 42. A layer restriction roller 46 is disposed in proximity to the developing roller 42 to restrict the layer thickness of the developer.

The photosensitive unit 30 and the developing device 40 are constituted integrally as a process cartridge 90. The process cartridge 90 is removably mounted to the body of the image forming apparatus 1. As illustrated in FIG. 1, the process cartridge 90 may be replaced by opening and closing the open/close member 100 which is provided on the body of the image forming apparatus 1 so as to be openable and closable in the case where the photosensitive drum 31 reaches its end of life or the like.

The toner cartridge 50 is removably mounted to an end portion of the process cartridge 90 on the side opposite to an end portion to which the photosensitive unit 30 is mounted. The toner cartridge 50 may be mounted to and removed from the process cartridge 90 with the process cartridge 90 mounted to the body of the image forming apparatus 1.

The exposure device 60 includes a laser beam output unit 61 that is usable as a light source, and a rotary multi-faceted mirror (polygon mirror) 62 that deflects a laser beam LB from the laser beam output unit 61, and scans a surface of the photosensitive drum 31 with the laser beam LB which has been modulated in accordance with image data to be formed.

The surface of the photosensitive drum 31 which is rotatable is charged by the charging roller 32. An electrostatic latent image is formed on the surface of the photosensitive drum 31 by the exposure device 60. The electrostatic latent image formed on the photosensitive drum 31 is developed as a toner image by the developing roller 42.

The transfer device 70 is composed of the rear cover 1*b* and the transfer roller 72. The rear cover 1*b* supports the transfer roller 72 so that the transfer roller 72 comes into and out of contact with the photosensitive drum 31. The transfer roller 72 forms a nip together with the photosensitive drum 31. A transfer voltage is applied to the transfer roller 72 from the power source device 14 which is controlled by the image forming apparatus control section 11. The toner image on the photosensitive drum 31 is transferred to the paper P which passes between the photosensitive drum 31 and the transfer roller 72.

Residual toner remaining on the surface of the photosensitive drum 31 is removed by the cleaning blade 34, and recovered into the unit housing 35 which supports the photosensitive drum 31. After that, the surface of the photosensitive drum 31 is recharged by the charging roller 32. The residue that is not removed by the cleaning blade 34 but attached to the charging roller 32 is captured by the surface of the cleaning roller 33 which rotates in contact with the charging roller 32, and thereafter discharged onto the photosensitive drum 31 again by way of the charging roller 32.

The fixing device 80 includes a pair of a heating module 81 and a pressurizing module 82. A press contact region between the heating module 81 and the pressurizing module 82 forms a fixing nip portion (fixing region).

The paper P to which the toner image has been transferred by the transfer roller 72 is transported to the fixing device 80 by way of a transport guide 74 with the toner image unfixed. When the paper P is transported to the fixing device 80, the toner image is fixed by the pair of the heating module 81 and the pressurizing module 82 by the action of pressure bonding and heating. After the toner image is fixed, the paper P is ejected by an ejection roller pair 84 to the upper cover 1*c* on the upper surface of the image forming apparatus 1.

(2) Open/Close Structure

Figure 2:
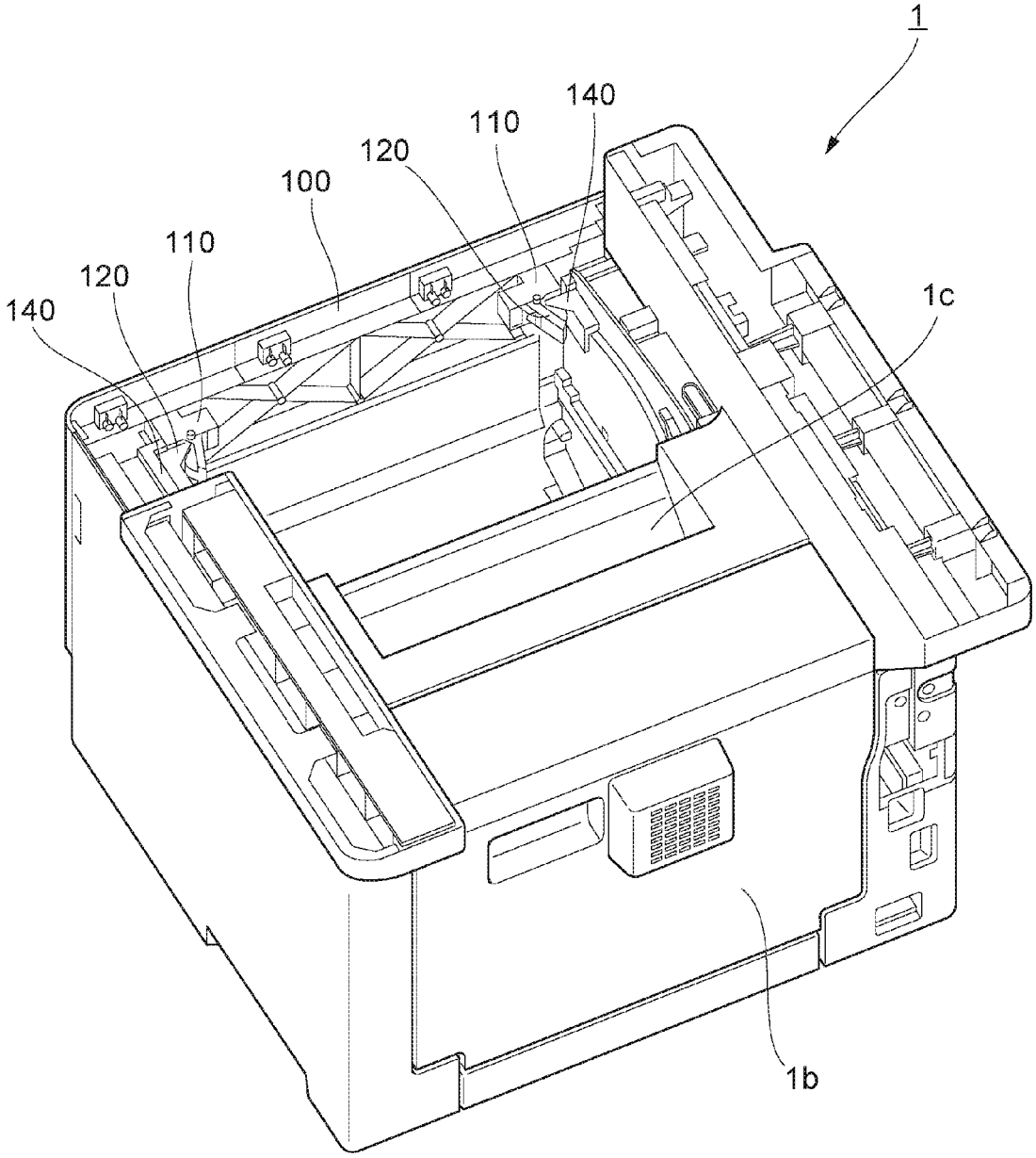
FIG. 2 is a perspective view illustrating a state in which an open/close member 100 of the image forming apparatus 1 is at a closed position and engaged with an apparatus body with internal constituent members omitted.
Figure 3:
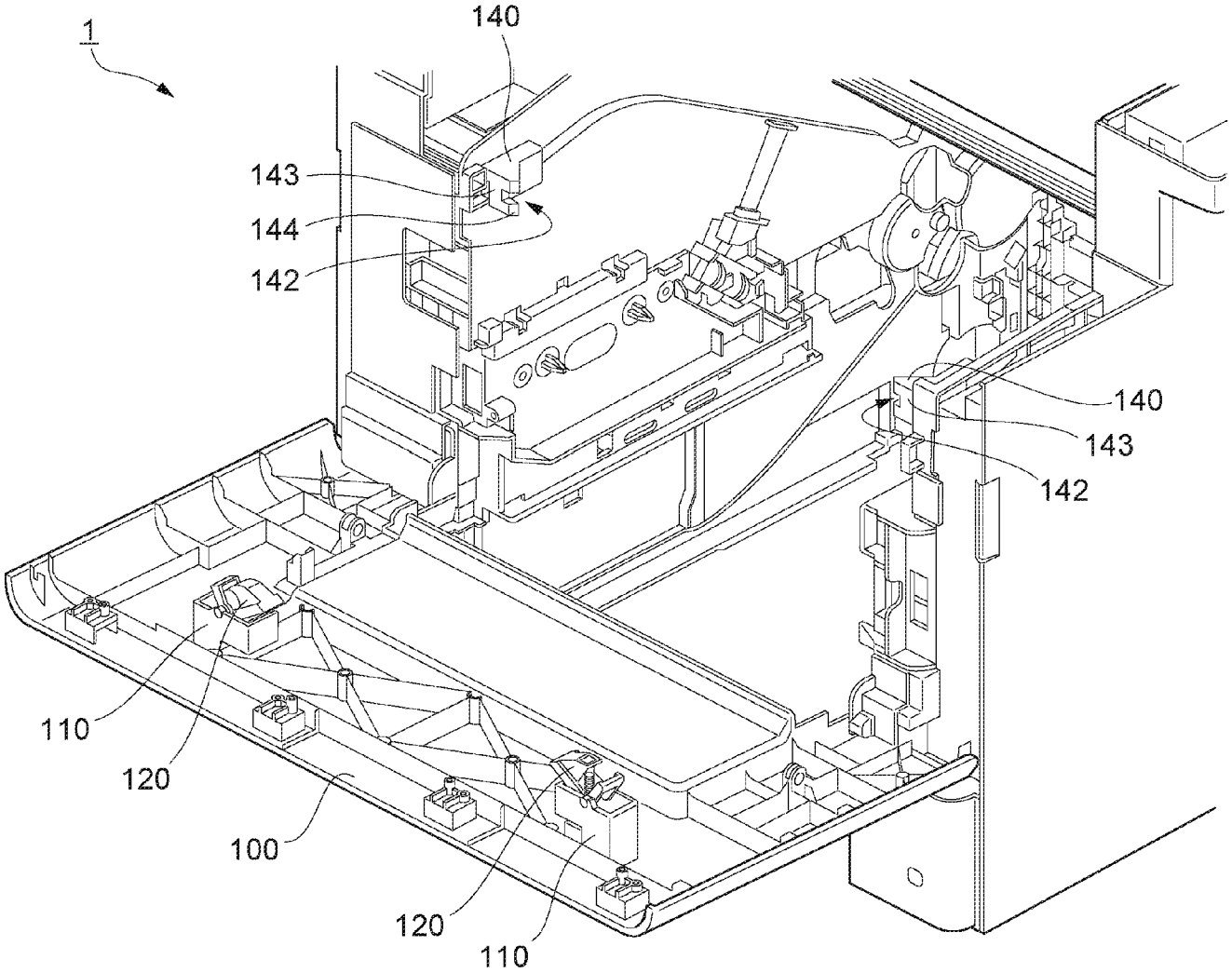
FIG. 3 is a perspective view illustrating a state in which the open/close member 100 of the image forming apparatus 1 is positioned at an open position with internal constituent members omitted.
Figure 4A:
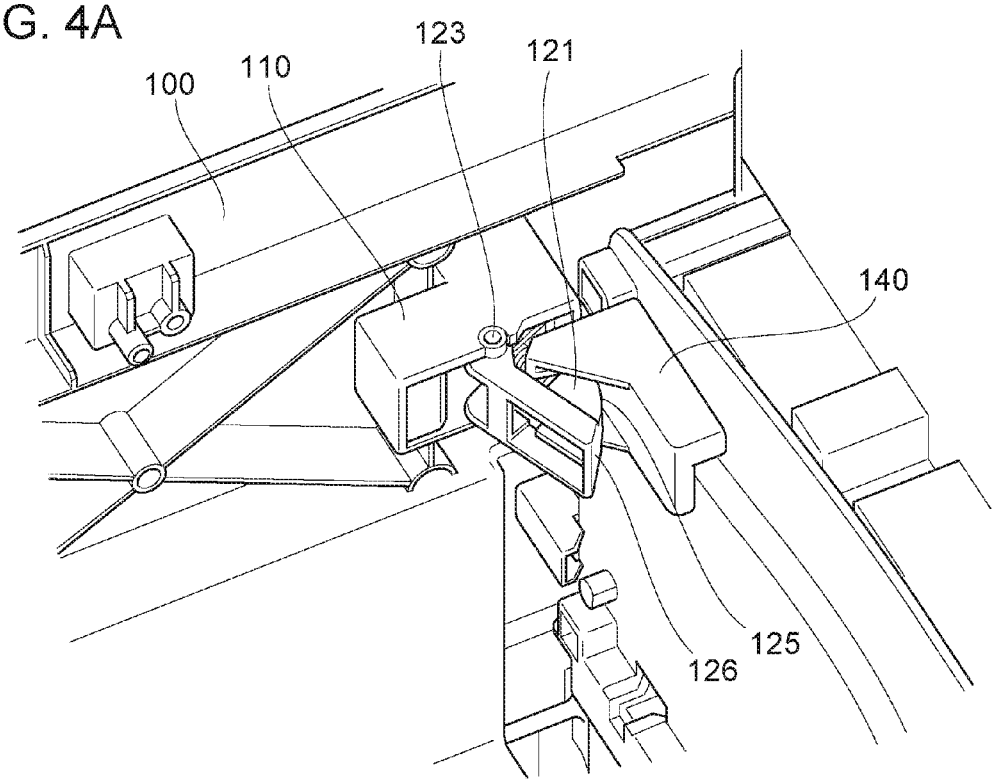
FIG. 4A is a partial perspective view illustrating a state in which an engaging member 120 is engaged with an engaged portion 140 of the apparatus body.
Figure 4B:
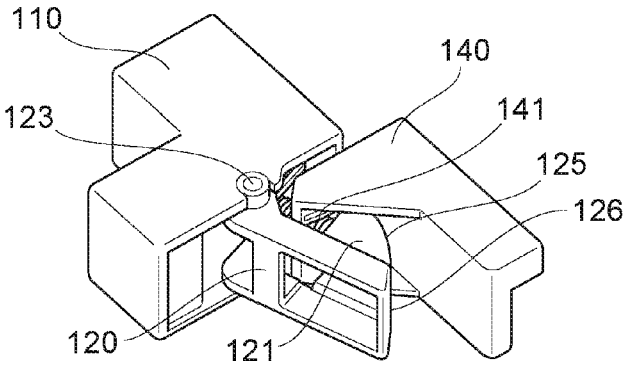
FIGS. 4B and 4C are each a partial perspective view illustrating the state of engagement between the engaging member 120 and the engaged portion 140.
Figure 4C:
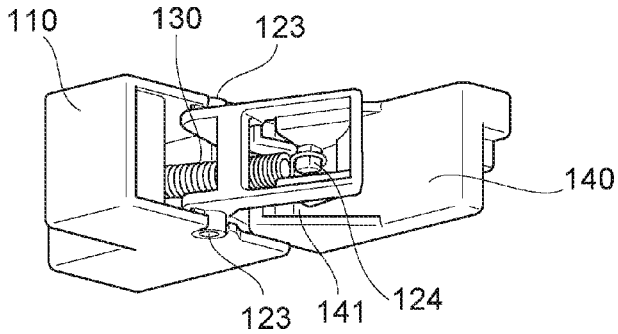
Figure 5A:
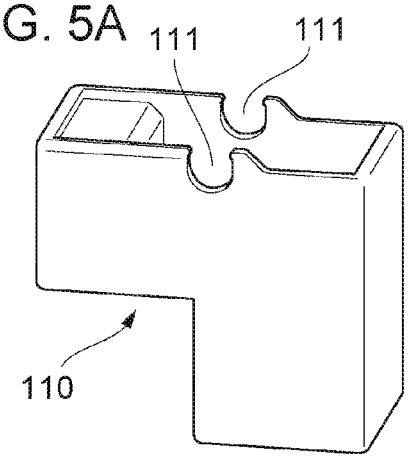
FIGS. 5A and 5B are each a perspective view of a support member 110.
Figure 5B:
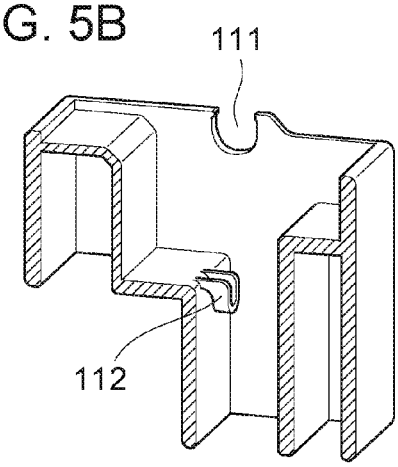
Figure 5C:
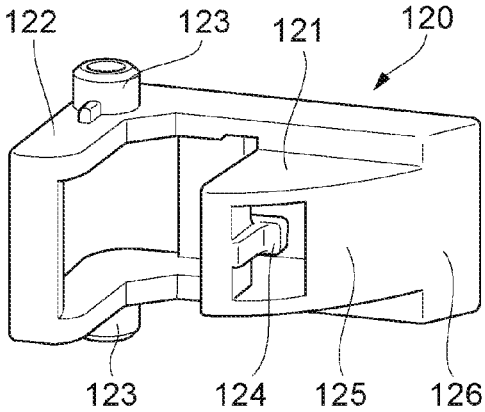
FIGS. 5C and 5D are each a perspective view of the engaging member 120.
Figure 5D:
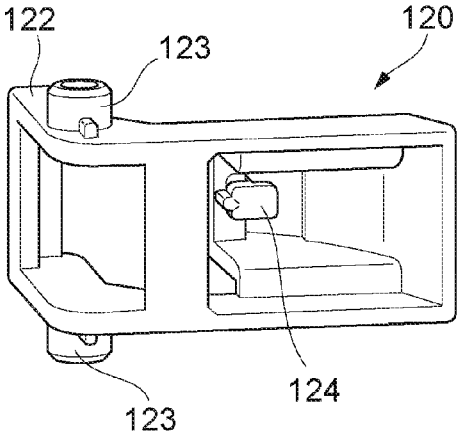
Figure 5E:
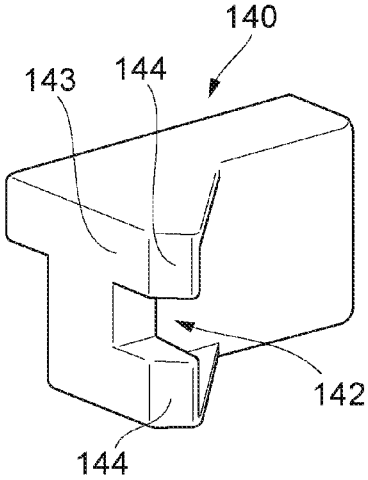
FIGS. 5E and 5F are each a perspective view of the engaged portion 140.
Figure 5F:
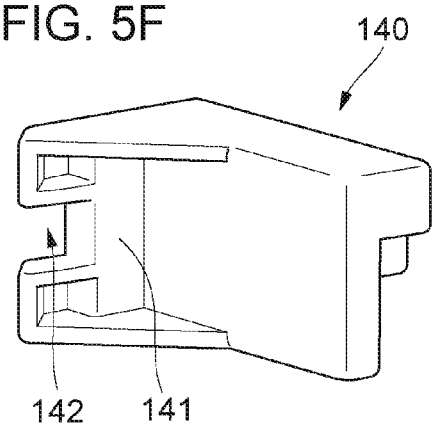
Figure 6A:
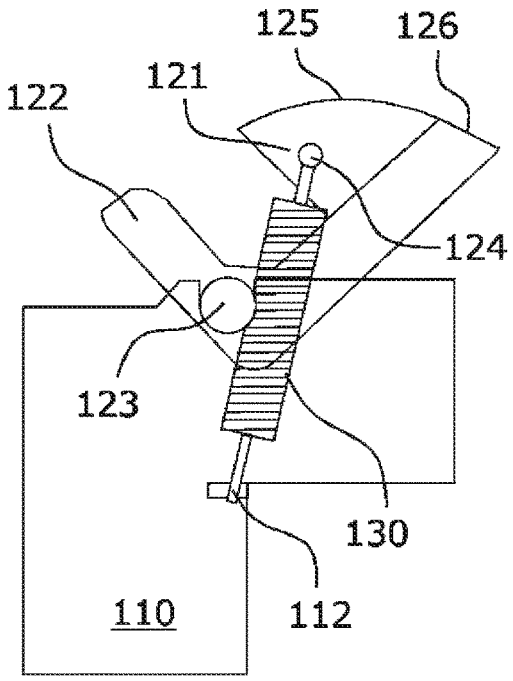
FIG. 6A is a schematic sectional view illustrating the engaging member 120 at an initial position.
Figure 6B:
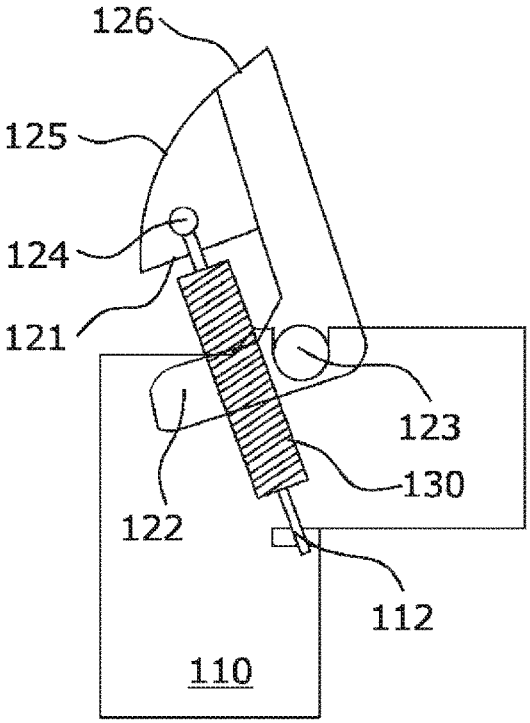
FIG. 6B is a schematic sectional view illustrating the engaging member 120 at a drawn position.

FIG. 2 is a perspective view illustrating a state in which the open/close member 100 of the image forming apparatus 1 is at a closed position and engaged with the apparatus body with internal constituent members omitted. FIG. 3 is a perspective view illustrating a state in which the open/close member 100 of the image forming apparatus 1 is positioned at an open position with internal constituent members omitted. FIG. 4A is a partial perspective view illustrating a state in which the engaging member 120 is engaged with the engaged portion 140 of the apparatus body. FIGS. 4B and 4C are each a partial perspective view illustrating the state of engagement between the engaging member 120 and the engaged portion 140. FIGS. 5A and 5B are each a perspective view of a support member 110. FIGS. 5C and 5D are each a perspective view of the engaging member 120. FIGS. 5E and 5F are each a perspective view of the engaged portion 140. FIG. 6A is a schematic sectional view illustrating the engaging member 120 at a release position. FIG. 6B is a schematic sectional view illustrating the engaging member 120 at a fixing position. The open/close structure of the image forming apparatus 1 according to the exemplary embodiment will be described below with reference to the drawings.

(2.1) Overall Configuration of Open/Close Structure

In FIGS. 1 and 3, the open/close member 100, which is rotatably supported on the left side of the image forming apparatus 1, is supported so as to be movable between the open position at which the inside of the apparatus body is exposed and the closed position at which the inside of the apparatus body is covered.

A center of rotation 100*a* is formed at the lower end portion of the open/close member 100. The open/close member 100 is supported on the apparatus body so as to be rotatable about the center of rotation 100*a*.

The engaging member 120 is rotatably supported by the support member 110 on the inner surface side of the open/close member 100. The engaged portion 140 is fixed on the apparatus body side.

When the open/close member 100 is rotationally moved from the open position to the closed position, the engaging member 120 is engaged with the engaged portion 140 on the apparatus body side while rotating so that the open/close member 100 closes the apparatus body.

To open the apparatus body, engagement between the engaging member 120 and the engaged portion 140 on the apparatus body side is canceled by performing a drawing operation on the open/close member 100 to rotationally move the open/close member 100 to the open position.

In the exemplary embodiment, the engaging member 120 is provided on the open/close member 100, and the engaged portion 140 is provided on the apparatus body side. However, the present invention is not limited thereto. The engaging member 120 may be provided on the apparatus body side, and the engaged portion 140 may be provided on the open/close member 100.

(2.2) Support Member

As illustrated in FIGS. 5A and 5B, the support member 110 has a box shape as a whole, and has shaft receiving portions 111 that rotatably support rotary shaft portions 123 of the engaging member 120. In addition, a hook portion 112 for attachment of one end of an urging member 130 is formed on the inner surface side of the support member 110.

The support member 110 is fixed on the inner surface side of the open/close member 100, and rotatably supports the engaging member 120.

(2.3) Engaging Member

As illustrated in FIGS. 5C and 5D, the engaging member 120 has an engaging portion 121 to be engaged with the engaged portion 140, a lever portion 122 that contacts the engaged portion 140 to guide the engaging portion 121 to the engaged portion 140 when the open/close member 100 is moved from the open position to the closed position, and the rotary shaft portions 123, and have a hook shape as a whole.

An arcuate shape portion 125 and an inclined surface portion 126 are formed on the outer side of the engaging portion 121 as seen from the rotary shaft portions 123. In addition, a hook portion 124 for attachment of the other end of the urging member 130 is formed on the inner surface side of the engaging portion 121.

The engaging member 120 is urged with respect to the support member 110 by the urging member 130 with the rotary shaft portions 123 rotationally supported by the shaft receiving portions 111 of the support member 110. As a result, the engaging member 120 is rotatably supported on the inner surface side of the open/close member 100.

(2.4) Engaged Portion

As illustrated in FIGS. 5E and 5F, the engaged portion 140 has an engaged surface 141 that receives the engaging portion 121 of the engaging member 120. A notched portion 142 is provided at the middle portion of the engaged surface 141. The urging member 130, one end and the other end of which are fixed to the support member 110 and the engaging member 120, respectively, is housed in the notched portion 142 when the engaging member 120 is rotated in the fixing direction.

The thus configured engaging member 120 is rotatably supported on the open/close member 100 via the support member 110 while being urged to be rotatable forward and in reverse, with the rotary shaft portions 123 serving as the center of rotation, by the urging member 130, the urging direction of which is changeable between two directions, namely a fixing direction (fixing position), in which the engaging member 120 is drawn into the engaged portion 140 as illustrated in FIG. 6A, and a releasing direction (release position), which is opposite to the fixing direction and in which the engaging member 120 is moved away from the engaged portion 140.

Specifically, in the case where the hook portion 124 of the engaging member 120, to which the other end of the urging member 130 is attached, is positioned on the engaged portion 140 side with respect to an axis C1 that connects the hook portion 112 of the support member 110, to which one end of the urging member 130 is attached, and the rotary shaft portions 123 of the engaging member 120 to each other, the engaging member 120 is drawn toward the fixing position by the urging force of the urging member 130.

In the case where the hook portion 124 of the engaging member 120, to which the other end of the urging member 130 is attached, is positioned on the left side with respect to the axis C1, the engaging member 120 is urged in the direction opposite to the fixing direction by the urging force of the urging member 130 to be returned to the release position.

[Modification]

Figure 9A:
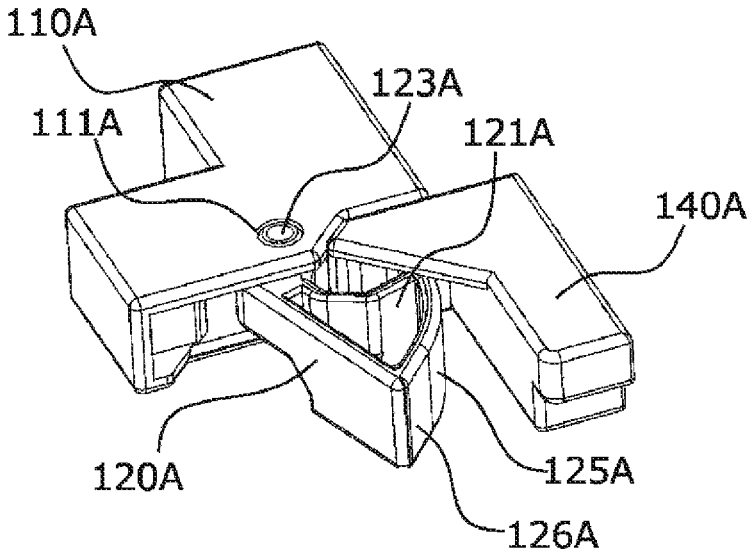
FIGS. 9A and 9B are each a partial perspective view illustrating the state of engagement between an engaging member 120A and an engaged portion 140A according to a modification.
Figure 9B:
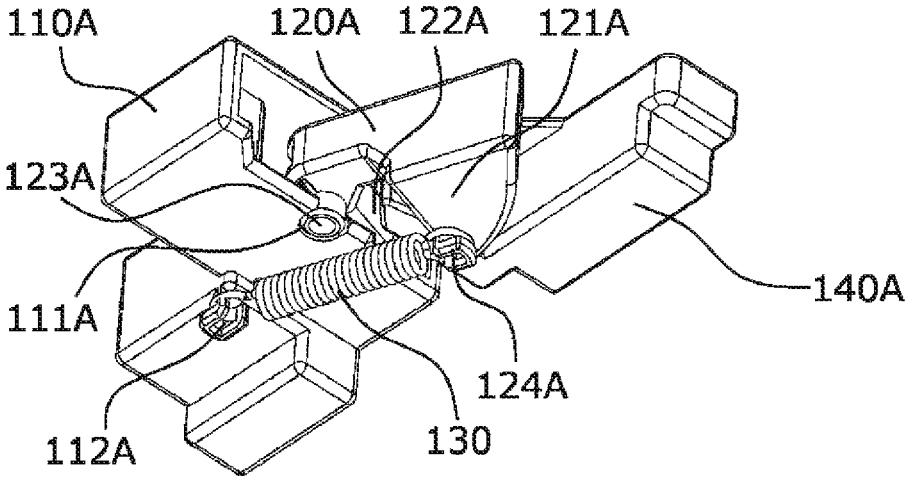

FIGS. 9A and 9B illustrate the state of engagement between an engaging member 120A and an engaged portion 140A according to a modification.

The engaging member 120A has an engaging portion 121A to be engaged with the engaged portion 140A, a lever portion 122A that contacts the engaged portion 140A to guide the engaging portion 121A to the engaged portion 140A when the open/close member 100 is moved from the open position to the closed position, and rotary shaft portions 123A, and have a hook shape as a whole.

An arcuate shape portion 125A and an inclined surface portion 126A are formed on the outer side of the engaging portion 121A as seen from the rotary shaft portions 123A. In addition, a hook portion 124A for attachment of the other end of the urging member 130 is formed on the outer surface side of the engaging portion 121A.

As illustrated in FIGS. 9A and 9B, a support member 110A has a box shape as a whole, and has shaft receiving portions 111A that rotatably support the rotary shaft portions 123A of the engaging member 120A. In addition, a hook portion 112A for attachment of one end of the urging member 130 is formed on the outer surface side of the support member 110A.

The support member 110A is fixed on the inner surface side of the open/close member 100, and rotatably supports the engaging member 120A.

With the support member 110A and the engaging member 120A according to the modification, the urging member 130 which urges the engaging member 120A in two directions, namely the fixing direction in which the engaging member 120A is drawn into the engaged portion 140A and the releasing direction which is opposite to the fixing direction and in which the engaging member 120A is moved away from the engaged portion 140A, may be easily attached from the outer side.

(3) Opening/Closing Operation of Open/Close Member

FIGS. 7A to 7D are each a schematic view illustrating a process in which the engaging member 120 is engaged with the engaged portion 140 when the open/close member 100 is moved from the open position to the closed position.

FIGS. 8A to 8G are each a schematic view illustrating a process in which the engaging member 120 is engaged with the engaged portion 140 when the open/close member 100 is moved from the open position to the closed position with the engaging member 120 rotated in the fixing direction.

The opening/closing operation of the open/close member 100 according to the exemplary embodiment will be described below with reference to the drawings.

(3.1) In Case where Engaging Member 120 is at Initial Position

Figure 7A:
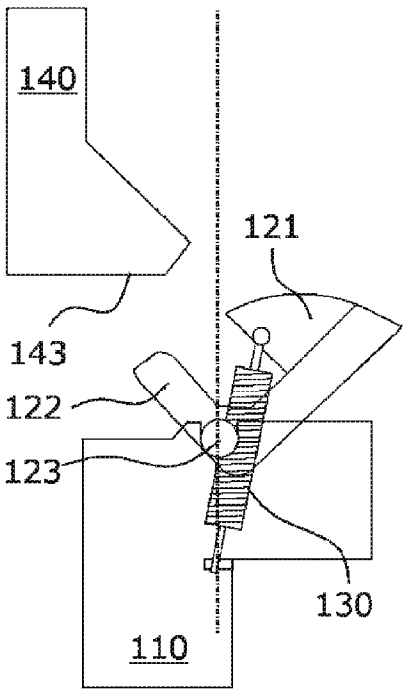
FIGS. 7A to 7D are each a schematic view illustrating a process in which the engaging member 120 is engaged with the engaged portion 140 when the open/close member 100 is moved from the open position to the closed position.
Figure 7B:
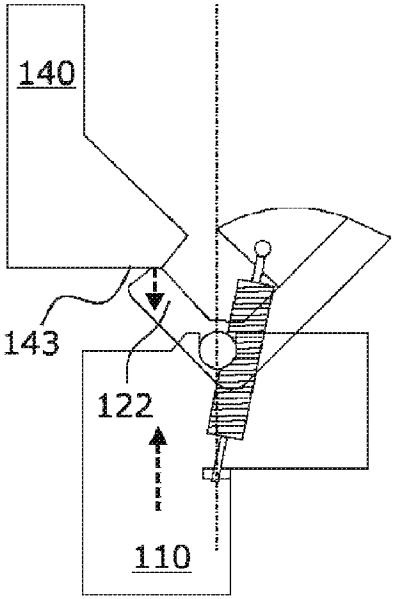

As illustrated in FIG. 7A, when the open/close member 100 is at the open position, the engaging member 120 is urged in the releasing direction (at the release position) by the urging force of the urging member 130. In the case where the open/close member 100 in such a state is subjected to a closing operation, the lever portion 122 of the engaging member 120 first contacts a front surface 143 of the engaged portion 140 along with rotational movement of the open/close member 100 (see FIG. 7B).

Figure 7C:
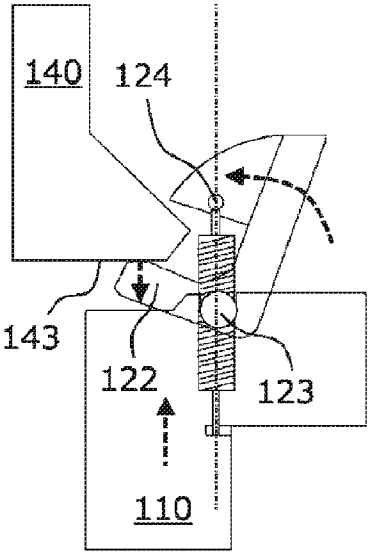

When the closing operation on the open/close member 100 is further continued, the lever portion 122 of the engaging member 120 receives a rotational force from the front surface 143 of the engaged portion 140, the engaging member 120 is rotated toward the engaged portion 140 from the release position, and the hook portion 124 of the engaging member 120 reaches a position on the axis C1 (neutral position; see FIG. 7C).

Figure 7D:
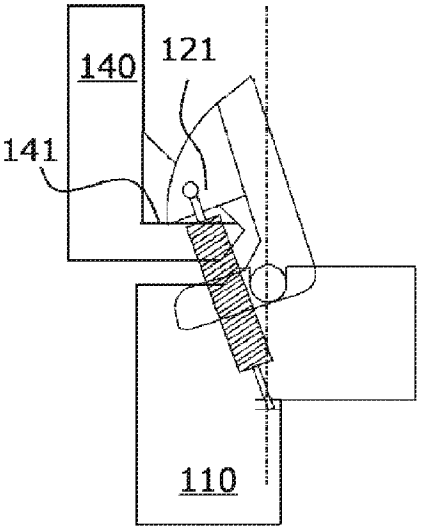

When the open/close member 100 is further rotationally moved, the engaging member 120 is drawn toward the engaged surface 141 of the engaged portion 140 by the urging force of the urging member 130 into the fixing position to be engaged with the engaged portion 140, and the open/close member 100 is positioned at the closed position (see FIG. 7D).

With the open/close structure according to the exemplary embodiment, when the lever portion 122 contacts one surface of the engaged portion 140 on the apparatus body side along with the closing operation of the open/close member 100, the lever portion 122 is rotated toward the engaged portion 140. When the hook portion 124 of the engaging member 120 is moved past the neutral position, the hook portion 124 is drawn toward the engaged surface 141 of the engaged portion 140 by the urging force of the urging member 130.

To expose the inside of the apparatus body, the engaging member 120 is rotated away from the engaged portion 140 in the releasing direction, which is opposite to the fixing direction, by just performing a drawing operation on the open/close member 100 to rotationally move the open/close member 100 to the open position. When the hook portion 124 of the engaging member 120 is moved past the neutral position, the engaging member 120 is drawn back to the release position by the urging force of the urging member 130 to cancel engagement between the engaging member 120 and the engaged portion 140 on the apparatus body side.

(3.2) In Case where Engaging Member 120 is at Fixing Position

Figure 8A:
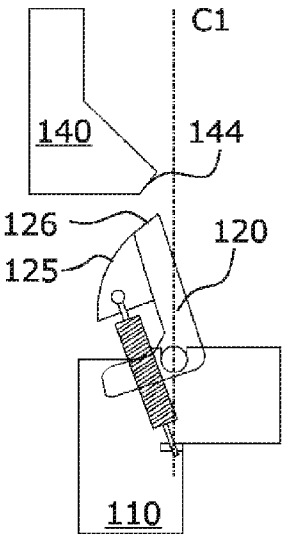
FIGS. 8A to 8G are each a schematic view illustrating a process in which the engaging member 120 is engaged with the engaged portion 140 when the open/close member 100 is moved from the open position to the closed position with the engaging member 120 rotated in a fixing direction.
Figure 8B:
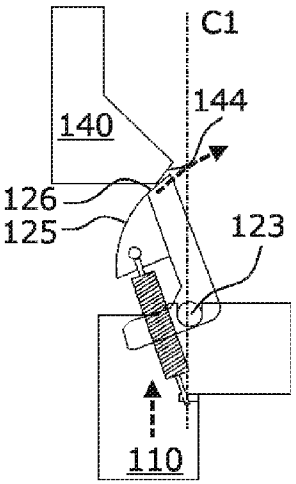

As illustrated in FIG. 8A, in the case where the open/close member 100 is subjected to a closing operation from a state in which the engaging member 120 is urged in the fixing direction (at the drawn position) by the urging force of the urging member 130, the inclined surface portion 126 of the engaging member 120 first contacts an inclined surface portion 144 of the engaged portion 140 along with rotational movement of the open/close member 100 (see FIG. 8B).

Figure 8C:
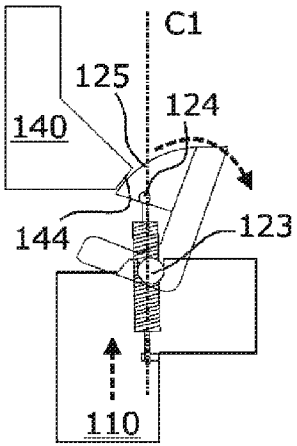

When the closing operation on the open/close member 100 is further continued, the arcuate shape portion 125 of the engaging member 120 receives a rotational force while sliding over the inclined surface portion 144 of the engaged portion 140, the engaging member 120 is rotated in the direction opposite to the fixing direction, and the hook portion 124 of the engaging member 120 reaches a position on the axis C1 (neutral position; see FIG. 8C).

Figure 8D:
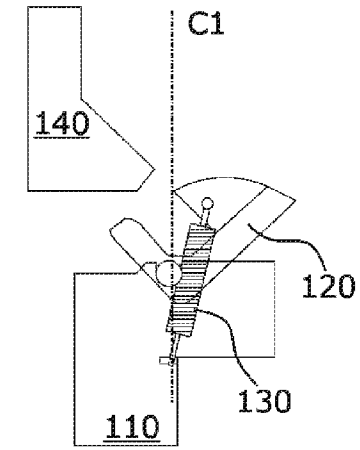

When the open/close member 100 is further rotationally moved, the engaging member 120 is returned to the release position by the urging force of the urging member 130 (see FIG. 8D).

Figure 8G:
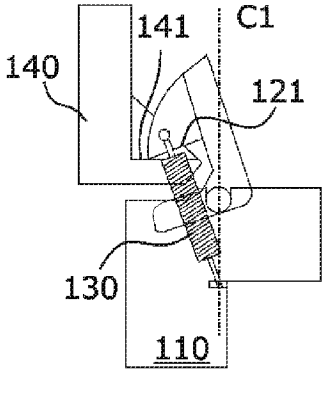
Figure 8F:
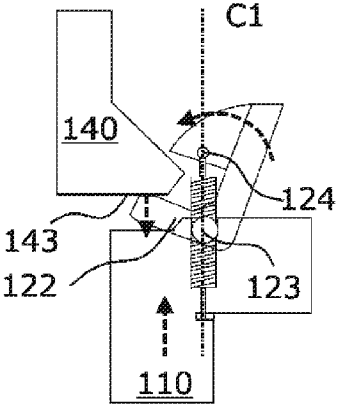
Figure 8E:
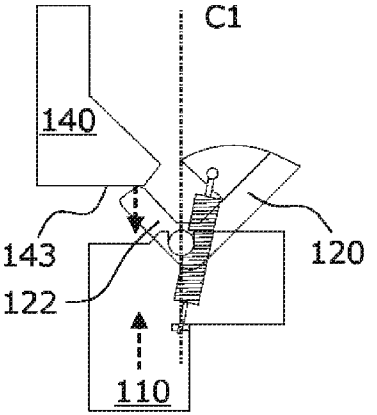

When the closing operation on the open/close member 100 is further continued, the lever portion 122 of the engaging member 120 contacts the front surface 143 of the engaged portion 140 (see FIG. 8E) to receive a rotational force from the front surface 143 of the engaged portion 140, the engaging member 120 is rotated toward the engaged portion 140 from the release position, and the hook portion 124 of the engaging member 120 reaches a position on the axis C1 (neutral position; see FIG. 8F).

When the open/close member 100 is rotationally moved, the engaging member 120 is drawn toward the engaged surface 141 of the engaged portion 140 by the urging force of the urging member 130 to be engaged with the engaged portion 140, and the open/close member 100 is positioned at the closed position (see FIG. 8G).

With the open/close structure according to the exemplary embodiment, even in the case where the engaging member 120 is positioned at the fixing position, the engaging member 120 is rotated in the direction opposite to the fixing direction to be returned to the release position with the arcuate shape portion 125 of the engaging member 120 receiving a rotational force while sliding as the arcuate shape portion 125 contacts the front surface 143 of the engaged portion 140 along with the closing operation performed on the open/close member 100.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an open/close member supported so as to be movable between an open position at which an inside of an apparatus body is exposed and a closed position at which the inside of the apparatus body is covered;

an engaged portion provided on one of the apparatus body and the open/close member;

an engaging member having an engaging portion that is engageable with the engaged portion and a lever portion that contacts the engaged portion before the engaging portion contacts the engaged portion in response to moving the open/close member from the open position to the closed position, to guide the engaging portion to the engaged portion when the open/close member is moved from the open position to the closed position, the engaging member being provided on the other of the apparatus body and the open/close member and being rotatable about an axis in both a clockwise and counter-clockwise direction; and an urging member that urges the engaging member, an urging direction of the urging member being changeable between two urging directions including a fixing direction in which the engaging member is drawn into the engaged portion and a releasing direction in which the engaging member is moved away from the engaged portion.

2. The image forming apparatus according to claim 1, wherein the engaging member has an arcuate shape portion on an outer side of the engaging portion, and, when the open/close member is moved from the open position to the closed position, the arcuate shape portion is rotated in the releasing direction while contacting the engaged portion.

3. The image forming apparatus according to claim 1, wherein the engaged portion has a notched portion provided in an engaged surface that receives the engaging portion of the engaging member, and the urging member is housed in the notched portion when the engaging member is rotated in the fixing direction with a first end and a second end of the urging member fixed to the open/close member and the engaging member, respectively.

4. The image forming apparatus according to claim 2, wherein the engaged portion has a notched portion provided in an engaged surface that receives the engaging portion of the engaging member, and the urging member is housed in the notched portion when the engaging member is rotated in the fixing direction with a first end and a second end of the urging member fixed to the open/close member and the engaging member, respectively.

5. The image forming apparatus according to claim 1, wherein a first end and a second end of the urging member are fixed to the open/close member and one outer surface of the engaging member, respectively.

6. The image forming apparatus according to claim 2, wherein a first end and a second end of the urging member are fixed to the open/close member and one outer surface of the engaging member, respectively.

7. The image forming apparatus according to claim 1, wherein the lever is provided on an end of the engaging member opposite the engaging portion.

8. An image forming apparatus comprising:

an open/close member supported so as to be movable between an open position at which an inside of an apparatus body is exposed and a closed position at which the apparatus body is closed;

an engaged portion provided on one of the apparatus body and the open/close member; and an engaging member provided on the other of the apparatus body and the open/close member, the engaging member being switchable between a fixing position at which the engaging member is engaged with the engaged portion and a release position at which the engaging member is moved away from the engaged portion, wherein, when the engaging member is at the fixing position in a case where the open/close member is moved from the open position to the closed position, the engaged portion moves the engaging member to the release position away from the fixing position, and thereafter the engaged portion contacts a lever portion of the engaging member contacting the engaged portion before the engaging portion contacts the engaged portion to switch the engaging member to the fixing position.

9. The image forming apparatus according to claim 8, wherein the lever is provided on an end of the engaging member opposite the engaging portion.

10. An image forming apparatus comprising:

an open/close member supported so as to be movable between an open position at which an inside of an apparatus body is exposed and a closed position at which the inside of the apparatus body is covered;

an engaged portion provided on one of the apparatus body and the open/close member;

an engaging member having an engaging portion that is engageable with the engaged portion and a lever portion that contacts the engaged portion to guide the engaging portion to the engaged portion when the open/close member is moved from the open position to the closed position, the engaging member being provided on the other of the apparatus body and the open/close member and being rotatable about an axis in both a clockwise and counter-clockwise direction; and an urging member that urges the engaging member, an urging direction of the urging member being changeable between two urging directions including a fixing direction in which the engaging member is drawn into the engaged portion and a releasing direction in which the engaging member is moved away from the engaged portion, wherein the engaged portion has a notched portion provided in an engaged surface that receives the engaging portion of the engaging member, and the urging member is housed in the notched portion when the engaging member is rotated in the fixing direction with a first end and a second end of the urging member fixed to the open/close member and the engaging member, respectively.

* * * * *